United States Patent [19]

Slaybaugh

[11] 4,260,055

[45] Apr. 7, 1981

[54] KIT FOR CLIPPING SORTING AND REDEEMING COUPONS

[76] Inventor: Ann G. Slaybaugh, 1701 Park Grove Rd., Catonsville, Md. 21228

[21] Appl. No.: 12,226

[22] Filed: Feb. 14, 1979

[51] Int. Cl.[3] ..... A45C 11/18

[52] U.S. Cl. ..... 206/232; 150/34; 150/39; 206/234; 206/425

[58] Field of Search ..... 150/28 R, 30, 34, 38–39; 206/37–38, 223, 232, 234, 349, 472–473, 459, 574, 425

[56] References Cited

U.S. PATENT DOCUMENTS

| | | | |
|---|---|---|---|
| 1,644,830 | 10/1927 | Henderson | 206/232 X |
| 2,155,203 | 4/1939 | Polacsek | 206/38 R X |
| 2,292,029 | 8/1942 | Gold | 150/34 X |
| 2,439,731 | 4/1948 | Hawes | 150/38 X |
| 2,520,176 | 8/1950 | Stanley | 150/34 X |
| 3,164,430 | 1/1965 | Beem et al. | 206/232 X |
| 4,004,690 | 1/1977 | Giarritta | 206/425 |
| 4,134,437 | 1/1979 | Finn | 150/38 |

FOREIGN PATENT DOCUMENTS

| | | | |
|---|---|---|---|
| 117198 | 7/1918 | United Kingdom | 150/38 |
| 354218 | 8/1931 | United Kingdom | 150/30 |

*Primary Examiner*—Donald F. Norton
*Attorney, Agent, or Firm*—Harvey B. Jacobson

[57] ABSTRACT

A kit to enable a consumer to make maximum use of redeemable coupons when grocery shopping including a pair of scissors, an indexed storage area categorized in alphabetical order or in the order in which items are encountered during a normal shopping trip through a grocery store and a storage area for coupons which are used during a particular shopping trip so that they will be separated from the stored coupons thereby facilitating their redemption at the checkout counter. The kit is incorporated into a convenient size, foldable holder generally in the form of a wallet or the like to facilitate it being carried in a handbag, pocket, or the like.

3 Claims, 2 Drawing Figures

FIG. 1
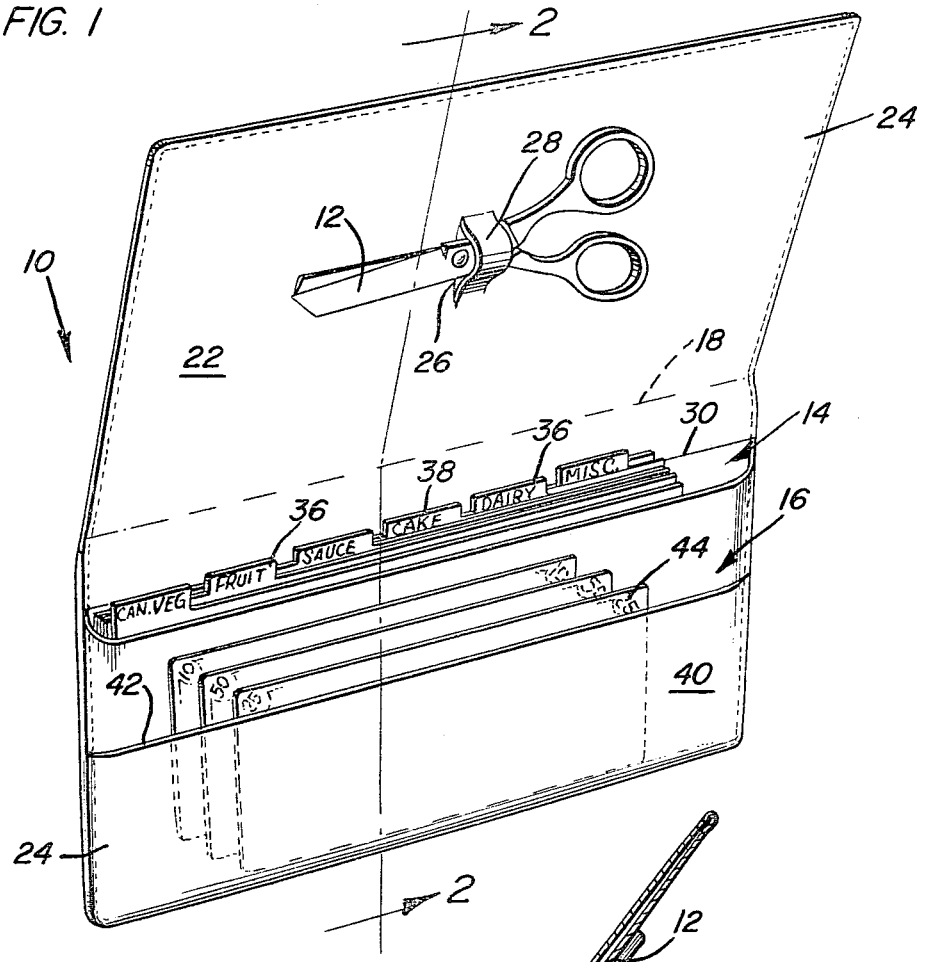
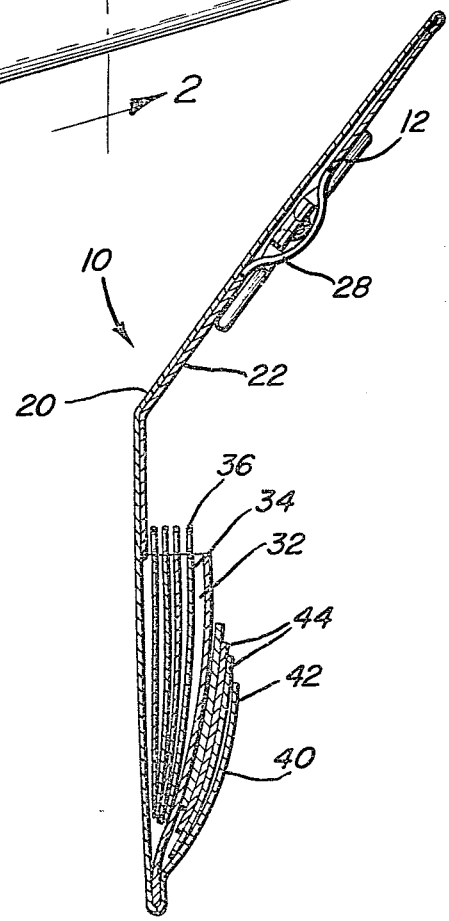
FIG. 2

KIT FOR CLIPPING SORTING AND REDEEMING COUPONS

BACKGROUND OF THE INVENTION

1. Field of the Invention

The present invention generally relates to a kit for clipping, storing and redeeming coupons such as those which appear in newspapers, magazines and the like which are redeemable for an indicated monetary sum when an article is purchased at a retail establishment such as a grocery store. The kit is in the form of a foldable holder constructed of any suitable type of flexible material and includes a pair of scissors conveniently supported in the holder to facilitate clipping the coupons, a storage area separated into a plurality of categorized and indexed spaces for storing the refund coupons and a storage area for temporarily storing coupons as items are selected from the store shelves so that those coupons to be redeemed will be separate from the stored coupons to facilitate their redemption at the checkout counter.

2. Description of the Prior Art

Various types of wallets, billfolds, card carrying cases, pocket receptacles are well-known and many of them include multiple pockets for storing various items, such as identification cards, vehicle operator's license, credit cards, photographs, and the like. The following U.S. patents are those known to applicant relevant to this invention.

U.S. Pat. No. 501,431—July 11, 1893—Lambert
U.S. Pat. No. 1,558,921—Oct. 27, 1925—Reichle
U.S. Pat. No. 2,379,672—July 3, 1945—Buxton
U.S. Pat. No. 2,406,672—Aug. 27, 1946—Dingman
U.S. Pat. No. 2,422,432—June 17, 1947—Miller
U.S. Pat. No. 2,871,901—Feb. 3, 1959—Nash
U.S. Pat. No. 3,048,210—Aug. 7, 1962—Fook
U.S. Pat. No. 3,392,771—July 16, 1968—Hartley
U.S. Pat. No. 3,877,729—Apr. 15, 1975—Friedman
U.S. Pat. No. 3,946,781—Mar. 30, 1976—Reis None of the above-mentioned patents discloses a kit specifically adapted for clipping, sorting and redeeming coupons.

SUMMARY OF THE INVENTION

An object of the present invention is to provide a conveniently carried kit to facilitate the clipping, sorting and redeeming of refund coupons such as those appearing in newspaper advertisements, magazine advertisements, as inserts into merchandising packaging and printed on merchandise containers and the like, including a pair of scissors to enable the coupons to be easily and accurately cutout, a categorized storage area for receiving the coupons separated into predetermined categories and a second storage area for receiving and temporarily storing selected coupons which are removed from the categorized storage area and placed in the second storage area as items are selected from the store shelves during a shopping trip through a store.

Another object of the invention is to provide a kit in accordance with the preceding object which is constructed of flexible, fabric-like material, such as leather, vinyl, natural fabric or synthetic fabric, and the like, of a size to enable folding into a convenient wallet size to facilitate it being carried in a pocket, handbag, or the like.

A further object of the present invention is to provide a kit in accordance with the present invention in which the categorized storage area is provided with dividers indexed in a manner to separate the coupons into alphabetical order or in the order in which the items involved would be encountered during a normal shopping trip through a grocery store at which a consumer normally shops and in which the layout of the store shelves and items thereon are known thereby facilitating selection and removal of the coupons from the categorized storage area as the items are selected and removed from the store shelves and placed into the shopping cart, thereby greatly reducing the time and facilitating the use of the coupons and providing the coupons which have been used in a separate storage area so that they may be easily removed and presented to a cashier at the checkout counter with the items selected and the associated coupons having the same position in the shopping cart and in the storage area respectively. For example, if the first items encountered in a shopping trip are canned vegetables, the first compartment in the categorized storage area would be labelled "canned vegetables". When a particular item is selected from the store shelf and placed in the grocery cart, the associated coupon will be removed from the categorized storage area and placed in the second storage area. As a second item is selected and placed in the shopping cart, a second coupon will be taken from the categorized storage area and placed in front of the first coupon inserted into the second storage area. Thus, the second item selected and placed in the cart will be above or on top of the first item and the selected coupons will be in the same sequence, thus facilitating the redemption at the checkout counter since in some instances, the coupon has to be presented to the cashier when the item is "rung up" on the cash register, whereas in other instances, the coupons may be presented at the end of the transaction and the cashier refunds the monetary amount of the coupon in cash to the customer.

Still another important object of the present invention is to provide a kit in accordance with the preceding objects which is relatively simple and inexpensive in construction, but yet durable and long lasting and effectively facilitates a consumer obtaining maximum benefit from redemption coupons.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the kit of the present invention illustrating the wallet-type structure in unfolded condition to show the position of the scissors when in stored position and the categorized storage area and second storage area for receiving coupons selected from the categorized storage area as items are removed from the store shelves and placed in a grocery cart.

FIG. 2 is a vertical sectional view taken along section line 2—2 on FIG. 1 illustrating the structural details of the device.

DESCRIPTION OF THE PREFERRED EMBODIMENT

Referring now specifically to the drawings, the kit of the present invention is designated by numeral 10 and includes a pair of scissors 12, a first storage area generally designated by the numeral 14 which is categorized in a manner described hereinafter and a second storage area 16 located in front of the storage area 14. The kit 10 is generally square or rectangular in configuration and provided with a central fold line 18 to enable the device to be folded into a wallet-shape or configuration. If desired, a tab with a snap fastener for mating with a snap fastener on the exterior of the kit may be provided to retain it in a folded and closed condition, if desired.

The kit 10 includes an external panel 20 and an internal panel 22 which are coextensive and secured together along the peripheral edges thereof as indicated by numeral 24 with the panels being secured together by conventional means such as stitching, heat sealing, or the like, depending upon the material from which the panels are constructed. For example, if the panels are constructed of natural or synthetic fabrics, stitching may be used with or without a bias tape or the like. If thermal plastic material, such as vinyl plastic, or the like, is used, then the peripheral edges may be heat sealed in a conventional manner. Also, the external surface of the panel 20 may be provided with any decorative indicia or instructive indicia including a fanciful name which may be provided for the kit.

To support the scissors 12, the interior of the upper portion of the internal panel 22 is provided with a pair of parallel, spaced slits 26 which define a loop 28 under which the blades of the scissors 12 may be slid to frictionally store the pair of scissors 12 centrally on the inner surface of the internal panel 22 so that they will be in readily accessible position for cutting out coupons from newspapers, magazines, and the like.

To form the categorized storage area 14, the internal panel 22 is provided with a slit 30 which extends from edge to edge of the panel 22 with the slit 30 being spaced from and parallel to the fold line 18, as illustrated in FIG. 1. Disposed within the pocket 32 formed by the slit 30 is a plurality of dividers or partitions 34 having upwardly extending tabs 36 at different longitudinal points thereon. Each of the tabs 36 is provided with indicia 38 which may be either alphabetical or descriptive of a single product or group of products. For example, a consumer frequently shops at the same store and becomes aware of the sequence of products appearing on the shelves or display areas in the different aisles of the store. Thus, the spaces defined by the dividers 34 may be designated by indicia relating to the aisles in a particular store so that the coupons for all of the items appearing in one particular aisle will be placed in the space designated for that particular aisle. The categories may also be numerically arranged, alphabetically arranged or arranged in any other grouping, but preferably in the sequence in which the items are encountered during a normal shopping trip of a consumer through a grocery store having a known layout, so that the items being encountered by the consumer will be in the same sequence or order as the categories and thus the coupons in the first storage area 14, thereby greatly facilitating the selection of the coupons from the storage area 14 when the particular items are selected from the store shelves and placed in the grocery cart.

The second storage area 16 is formed by an additional partial interior panel 40 which has its lower edge coinciding with and joined to the bottom edge of the panels 20 and 22 and the side edges joined to the side edges thereof by the same stitching, heat sealing, or the like, 24, thereby providing a pocket 42 for the selected coupons 44 which have been removed from the categorized storage area 14 and placed in the storage area 16 as illustrated in FIGS. 1 and 2. By placing the coupons in the storage area 16 in the same order in which the items are selected from the store shelves, the coupons will generally be in the same sequence as the items when they are removed from the shopping cart at the checkout counter, thus facilitating matching of the coupons with the associated item as the items are being "rung-up" by the cashier, so that appropriate refund in cash can be made to the consumer at the end of the transaction at the checkout counter. If it is desired to maintain the cash refund in a separate area to enable the consumer to determine just what cash value was obtained from the refund coupons, a separate compartment provided with a snap closure flap or zipper closure may be provided in or on the interior panel 22 which enables the cash refund to be maintained separate from other monies which the consumer may have.

The device may be constructed of various sizes and materials. For example, one embodiment of the invention has been constructed having dimensions of approximately 6½ inches long and 3½ inches wide when in closed condition or folded condition. The indexing partitions 34 may be constructed of any suitable material including fabrics, plastics, paper, or the like, and the tabs may be constructed so that they can be written upon to enable the device to be customized for each individual or the tabs may be pre-printed and may include color coding for futher facilitating the distinction between spaces between adjacent partitions. If desired, the partitions or dividers, if made of the same material, can also be stitched into the device along the side edges thereof and to provide for more spaces, dividers or partitions may be formed into a staggered or shingled arrangement to further facilitate the insertion of and removal of the coupons from the categorized storage area.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A kit to enable a consumer to make maximum use of redeemable coupons when shopping comprising a flexible member foldable along a center line into overlying top and bottom portions, the inner surface of one of the portions including a pair of pockets with one of the pockets including a plurality of dividers dividing the space interiorly of the pocket into a plurality of storage areas, each divider including a tab with indicia for categorizing the spaces between the dividers to receive redeemable coupons of a particular category, the other pocket adapted to receive coupons selected from the categorized storage areas as items are selected from a store shelf thereby facilitating the redemption of the coupons when paying for the selected items, said flexible member including inner and outer panels, said pocket having the dividers therein being formed by a longitudinal slit in the inner panel and the pocket adapted to receive selected coupons being formed by an additional partial panel mounted on the inner surface of the inner panel, said panels being secured together around the periphery thereof with the opening into the storage areas facing the central fold line to retain the coupons in the storage areas when the flexible member is folded about the center fold line.

2. The structure as defined in claim 1 wherein the inner surface of the flexible member includes supporting means for a pair of scissors to facilitate the coupons being cut out of a newspaper, magazine, or the like, said means being in the form of a loop formed by parallel slits in the flexible member.

3. The structure as defined in claim 2 wherein the pair of pockets are formed in the inner surface of the bottom portion of the flexible member, said loop for receiving and supporting scissors being formed in the inner surface of the top portion of the flexible member, said parallel slits defining the loop extending through only the inner panel with the slits being generally perpendicular to the longitudinal slit in the bottom portion of the foldable member whereby the scissors are oriented generally in parallel relation to the storage areas but on the opposite side of the center fold line, said top and bottom portions of the flexible member being generally rectangular with the pockets and dividers extending substantially throughout the length of the bottom portion of the flexible member, said tabs on the dividers being arranged in longitudinally staggered relation substantially throughout the length of the pocket to enable maximum categorization of the spaces between the dividers.

* * * * *